US007736279B2

(12) United States Patent
Dalebout et al.

(10) Patent No.: US 7,736,279 B2
(45) Date of Patent: Jun. 15, 2010

(54) ONE-STEP FOLDABLE ELLIPTICAL EXERCISE MACHINE

(75) Inventors: William T. Dalebout, North Logan, UT (US); Gaylen W. Ercanbrack, North, UT (US); N. Jeffrey Chatterton, Logan, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/676,643

(22) Filed: Feb. 20, 2007

(65) Prior Publication Data

US 2008/0200314 A1 Aug. 21, 2008

(51) Int. Cl.
*A63B 22/04* (2006.01)
*A63B 69/16* (2006.01)

(52) U.S. Cl. ..... 482/52; 482/51; 482/57

(58) Field of Classification Search ..... 482/52, 482/53, 57, 70, 71, 51
See application file for complete search history.

(56) References Cited

U.S. PATENT DOCUMENTS

| | | | |
|---|---|---|---|
| 3,316,898 | A | 5/1967 | Brown |
| 3,501,140 | A | 3/1970 | Eichorn |
| 3,756,595 | A | 9/1973 | Hague |
| 3,824,994 | A | 7/1974 | Soderberg, Sr. |
| 3,941,377 | A | 3/1976 | Lie |
| 4,140,312 | A | 2/1979 | Buchmann |
| 4,300,760 | A | 11/1981 | Bobroff |
| 4,354,675 | A | 10/1982 | Barclay |
| 4,679,787 | A | 7/1987 | Guilbault |
| 4,708,338 | A | 11/1987 | Potts |
| 4,720,093 | A | 1/1988 | Del Mar |
| 4,938,474 | A | 7/1990 | Sweeney et al. |
| 5,013,031 | A | 5/1991 | Bull |
| 5,039,088 | A | 8/1991 | Shifferaw |

(Continued)

FOREIGN PATENT DOCUMENTS

| | | |
|---|---|---|
| CN | 2169450 | 6/1994 |

(Continued)

OTHER PUBLICATIONS

Vision Fitness—About Our Ellipticals; www.visionfitness.com; taken from cite Sep. 13, 2005.

(Continued)

*Primary Examiner*—Loan Thanh
*Assistant Examiner*—Daniel F. Roland
(74) *Attorney, Agent, or Firm*—Workman Nydegger

(57) ABSTRACT

A folding elliptical exercise machine that allows for easy, safe, and quick storage and being capable, upon a single motion by a user, of changing its shape into a substantially compact form for storage, and vice versa, is provided. The elliptical exercise machine comprises first and second reciprocating foot supports interconnected to the frame, each foot support having a first end and a second end with a collapsible joint therebetween, wherein each reciprocating foot support is collapsible such that the exercise machine can be moved between the operating position and the storage position in a single step by rotating a rear portion of a base support structure upward and toward a front portion of the base support structure. A method for changing the position of the elliptical exercise machine of the present invention from an operating position to a storage position, and vice versa, also is provided.

37 Claims, 6 Drawing Sheets

U.S. PATENT DOCUMENTS

| | | | | | |
|---|---|---|---|---|---|
| 5,078,389 | A | | 1/1992 | Chen | |
| 5,135,447 | A | | 8/1992 | Robards, Jr. et al. | |
| 5,195,935 | A | | 3/1993 | Fencel | |
| 5,242,343 | A | | 9/1993 | Miller | |
| 5,279,529 | A | | 1/1994 | Eschenbach | |
| 5,279,531 | A | | 1/1994 | Jen-Huey | |
| D344,112 | S | | 2/1994 | Smith | |
| 5,290,211 | A | | 3/1994 | Stearns | |
| 5,299,993 | A | | 4/1994 | Habing | |
| 5,322,491 | A | | 6/1994 | Wanzer et al. | |
| D336,141 | S | | 8/1994 | Husted et al. | |
| 5,336,141 | A | | 8/1994 | Vittone | |
| 5,352,169 | A | * | 10/1994 | Eschenbach | 482/57 |
| 5,383,829 | A | | 1/1995 | Miller | |
| D356,128 | S | | 3/1995 | Smith et al. | |
| 5,415,607 | A | | 5/1995 | Carpenter | |
| 5,419,751 | A | | 5/1995 | Byrd et al. | |
| 5,423,729 | A | | 6/1995 | Eschenbach | |
| 5,435,799 | A | | 7/1995 | Lundin | |
| 5,435,801 | A | | 7/1995 | Hung | |
| D367,689 | S | | 3/1996 | Wilkinson et al. | |
| 5,499,956 | A | | 3/1996 | Habing et al. | |
| 5,518,473 | A | | 5/1996 | Miller | |
| 5,527,245 | A | | 6/1996 | Dalebout et al. | |
| 5,527,246 | A | | 6/1996 | Rodgers | |
| 5,529,554 | A | | 6/1996 | Eschenbach | |
| 5,529,555 | A | | 6/1996 | Rodgers, Jr. | |
| 5,540,637 | A | | 7/1996 | Rodgers, Jr. | |
| 5,549,526 | A | | 8/1996 | Rodgers, Jr. | |
| 5,562,574 | A | | 10/1996 | Miller | |
| 5,573,480 | A | | 11/1996 | Rodgers, Jr. | |
| 5,577,985 | A | | 11/1996 | Miller | |
| 5,591,107 | A | | 1/1997 | Rodgers | |
| 5,593,371 | A | | 1/1997 | Rodgers, Jr. | |
| 5,593,372 | A | * | 1/1997 | Rodgers, Jr. | 482/52 |
| 5,595,553 | A | | 1/1997 | Rodgers, Jr. | |
| 5,595,556 | A | * | 1/1997 | Dalebout et al. | 482/54 |
| 5,611,756 | A | | 3/1997 | Miller | |
| 5,611,757 | A | | 3/1997 | Rodgers | |
| 5,611,758 | A | | 3/1997 | Rodgers | |
| 5,616,103 | A | | 4/1997 | Lee | |
| 5,626,542 | A | | 5/1997 | Dalebout et al. | |
| 5,637,058 | A | | 6/1997 | Rodgers | |
| D380,509 | S | | 7/1997 | Wilkinson et al. | |
| 5,653,662 | A | | 8/1997 | Rodgers, Jr. | |
| D384,118 | S | | 9/1997 | Deblauw | |
| 5,672,140 | A | * | 9/1997 | Watterson et al. | 482/54 |
| 5,683,333 | A | | 11/1997 | Rodgers, Jr. | |
| 5,685,804 | A | | 11/1997 | Whan-Tong et al. | |
| 5,690,589 | A | | 11/1997 | Rodgers, Jr. | |
| 5,692,994 | A | | 12/1997 | Eschenbach | |
| 5,695,434 | A | | 12/1997 | Dalebout et al. | |
| 5,695,435 | A | * | 12/1997 | Dalebout et al. | 482/96 |
| 5,707,320 | A | | 1/1998 | Yu | |
| 5,707,321 | A | | 1/1998 | Maresh | |
| 5,722,922 | A | | 3/1998 | Watterson et al. | |
| 5,738,614 | A | | 4/1998 | Rodgers, Jr. | |
| 5,743,834 | A | | 4/1998 | Rodgers, Jr. | |
| 5,755,642 | A | | 5/1998 | Miller | |
| 5,766,113 | A | | 6/1998 | Rodgers, Jr. | |
| 5,772,558 | A | | 6/1998 | Rodgers, Jr. | |
| 5,779,599 | A | * | 7/1998 | Chen | 482/57 |
| 5,782,722 | A | | 7/1998 | Sands et al. | |
| 5,788,609 | A | | 8/1998 | Miller | |
| 5,788,610 | A | | 8/1998 | Eschenbach | |
| 5,792,026 | A | * | 8/1998 | Maresh et al. | 482/51 |
| 5,795,268 | A | | 8/1998 | Husted | |
| 5,813,949 | A | | 9/1998 | Rodgers, Jr. | |
| 5,823,917 | A | * | 10/1998 | Chen | 482/57 |
| 5,830,113 | A | | 11/1998 | Coody et al. | |
| 5,830,114 | A | | 11/1998 | Halfen et al. | |
| 5,833,582 | A | | 11/1998 | Chen | |
| 5,836,854 | A | * | 11/1998 | Kuo | 482/52 |
| D403,033 | S | | 12/1998 | Husted et al. | |
| 5,846,166 | A | * | 12/1998 | Kuo | 482/52 |
| 5,857,941 | A | | 1/1999 | Maresh et al. | |
| 5,860,893 | A | * | 1/1999 | Watterson et al. | 482/54 |
| 5,860,895 | A | | 1/1999 | Lee | |
| 5,873,608 | A | | 2/1999 | Tharp et al. | |
| 5,897,460 | A | * | 4/1999 | McBride et al. | 482/54 |
| 5,899,834 | A | * | 5/1999 | Dalebout et al. | 482/54 |
| 5,904,637 | A | * | 5/1999 | Kuo | 482/54 |
| 5,911,649 | A | | 6/1999 | Miller | |
| 5,913,751 | A | | 6/1999 | Eschenbach | |
| 5,916,064 | A | * | 6/1999 | Eschenbach | 482/51 |
| 5,916,065 | A | | 6/1999 | McBride | |
| 5,919,118 | A | | 7/1999 | Stearns et al. | |
| 5,924,962 | A | | 7/1999 | Rodgers, Jr. | |
| D413,366 | S | | 8/1999 | Husted et al. | D21/668 |
| 5,938,567 | A | | 8/1999 | Rodgers, Jr. | |
| 5,938,570 | A | | 8/1999 | Maresh | |
| 5,944,638 | A | | 8/1999 | Maresh et al. | |
| 5,947,872 | A | | 9/1999 | Ryan et al. | |
| 5,951,449 | A | | 9/1999 | Oppriecht | |
| 5,957,814 | A | | 9/1999 | Eschenbach | |
| 5,961,423 | A | | 10/1999 | Sellers | |
| 5,997,445 | A | | 12/1999 | Maresh et al. | |
| 6,001,046 | A | | 12/1999 | Chang | |
| 6,004,244 | A | | 12/1999 | Simonson | |
| 6,007,462 | A | | 12/1999 | Chen | |
| 6,019,710 | A | | 2/2000 | Dalebout | |
| 6,022,296 | A | | 2/2000 | Yu | |
| 6,024,676 | A | | 2/2000 | Eschenbach | |
| 6,027,431 | A | * | 2/2000 | Stearns et al. | 482/52 |
| 6,030,319 | A | | 2/2000 | Wu | |
| 6,030,320 | A | | 2/2000 | Stearns et al. | |
| 6,042,512 | A | | 3/2000 | Eschenbach | |
| 6,045,487 | A | | 4/2000 | Miller | |
| 6,099,439 | A | | 8/2000 | Ryan et al. | |
| 6,106,439 | A | | 8/2000 | Boland | |
| 6,123,649 | A | | 9/2000 | Lee et al. | |
| 6,123,650 | A | | 9/2000 | Birrell | |
| 6,135,927 | A | | 10/2000 | Lo | |
| 6,146,313 | A | | 11/2000 | Whan-Tong et al. | |
| 6,149,551 | A | | 11/2000 | Pyles et al. | |
| 6,165,107 | A | | 12/2000 | Birrell | |
| 6,171,217 | B1 | * | 1/2001 | Cutler | 482/57 |
| 6,176,814 | B1 | | 1/2001 | Ryan et al. | |
| 6,190,289 | B1 | * | 2/2001 | Pyles et al. | 482/52 |
| 6,196,948 | B1 | | 3/2001 | Stearns et al. | |
| 6,206,804 | B1 | | 3/2001 | Maresh | |
| 6,210,305 | B1 | | 4/2001 | Eschenbach | |
| 6,217,486 | B1 | * | 4/2001 | Rosenow | 482/52 |
| 6,248,044 | B1 | | 6/2001 | Stearns et al. | |
| 6,261,209 | B1 | | 7/2001 | Coody | |
| 6,277,055 | B1 | | 8/2001 | Birrell et al. | |
| 6,315,702 | B1 | | 11/2001 | Ikonomopoulos | 482/138 |
| 6,338,698 | B1 | * | 1/2002 | Stearns et al. | 482/52 |
| 6,361,476 | B1 | | 3/2002 | Eschenbach | |
| 6,368,252 | B1 | | 4/2002 | Stearns | |
| 6,390,953 | B1 | | 5/2002 | Maresh et al. | |
| 6,398,695 | B2 | | 6/2002 | Miller | |
| 6,409,632 | B1 | | 6/2002 | Eschenbach | |
| 6,422,976 | B1 | | 7/2002 | Eschenbach | |
| 6,422,977 | B1 | | 7/2002 | Eschenbach | |
| 6,436,007 | B1 | | 8/2002 | Eschenbach | |
| 6,440,042 | B2 | | 8/2002 | Eschenbach | |
| 6,482,132 | B2 | | 11/2002 | Eschenbach | |
| 6,500,096 | B1 | | 12/2002 | Farney | |
| 6,544,147 | B1 | * | 4/2003 | Wang et al. | 482/54 |
| 6,551,217 | B2 | | 4/2003 | Kaganovsky | |
| 6,582,343 | B2 | | 6/2003 | Lin et al. | |
| 6,612,969 | B2 | | 9/2003 | Eschenbach | |
| 6,645,125 | B1 | * | 11/2003 | Stearns et al. | 482/52 |

| | | | | |
|---|---|---|---|---|
| 6,685,607 | B1 | 2/2004 | Olson | |
| 6,730,002 | B2 | 5/2004 | Hald et al. | |
| 6,749,540 | B1 | 6/2004 | Pasero et al. | |
| 6,752,744 | B2 | 6/2004 | Arnold et al. | |
| 6,758,790 | B1 | 7/2004 | Ellis | |
| 6,783,481 | B2 | 8/2004 | Stearns et al. | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,949,053 | B1 | 9/2005 | Stearns et al. | |
| 6,949,054 | B1 | 9/2005 | Stearns et al. | |
| 6,979,283 | B2 | 12/2005 | Pan et al. | |
| 7,025,711 | B2 * | 4/2006 | Eschenbach | 482/52 |
| 7,033,305 | B1 * | 4/2006 | Stearns et al. | 482/52 |
| 7,052,440 | B2 | 5/2006 | Pyles et al. | 482/54 |
| 7,060,005 | B2 | 6/2006 | Carlsen et al. | |
| 7,097,592 | B2 | 8/2006 | Wang | |
| 7,169,087 | B2 * | 1/2007 | Ercanbrack et al. | 482/52 |
| 7,192,388 | B2 * | 3/2007 | Dalebout et al. | 482/54 |
| 7,201,707 | B1 * | 4/2007 | Moon | 482/52 |
| 7,214,167 | B2 * | 5/2007 | Stearns et al. | 482/52 |
| 7,278,955 | B2 | 10/2007 | Giannelli et al. | |
| D554,715 | S | 11/2007 | Giannelli et al. | |
| D563,489 | S | 3/2008 | Giannelli et al. | |
| D564,051 | S | 3/2008 | Giannelli et al. | |
| 7,513,855 | B1 | 4/2009 | Yeh | |
| 2002/0086779 | A1 | 7/2002 | Wilkinson | |
| 2002/0198084 | A1 * | 12/2002 | Stearns et al. | 482/57 |
| 2003/0045403 | A1 * | 3/2003 | Watterson et al. | 482/51 |
| 2003/0083177 | A1 | 5/2003 | Tung | |
| 2003/0092532 | A1 | 5/2003 | Giannelli et al. | |
| 2004/0077463 | A1 * | 4/2004 | Rodgers, Jr. | 482/52 |
| 2004/0132583 | A1 * | 7/2004 | Ohrt et al. | 482/52 |
| 2004/0157706 | A1 | 8/2004 | Miller | |
| 2004/0162191 | A1 * | 8/2004 | Ercanbrack et al. | 482/52 |
| 2004/0198561 | A1 | 10/2004 | Corbalis et al. | |
| 2004/0204294 | A2 | 10/2004 | Wilkinson et al. | 482/54 |
| 2004/0224825 | A1 | 11/2004 | Giannelli et al. | |
| 2005/0009668 | A1 * | 1/2005 | Savettiere et al. | 482/66 |
| 2005/0026752 | A1 | 2/2005 | Lull et al. | |
| 2005/0101463 | A1 | 5/2005 | Chen | |
| 2005/0130807 | A1 * | 6/2005 | Cutler et al. | 482/54 |
| 2005/0164837 | A1 * | 7/2005 | Anderson et al. | 482/52 |
| 2005/0181912 | A1 | 8/2005 | Eschenbach | |
| 2005/0202939 | A1 | 9/2005 | Lull et al. | |
| 2005/0209059 | A1 | 9/2005 | Crawford et al. | |
| 2006/0019804 | A1 | 1/2006 | Young | |
| 2006/0035754 | A1 | 2/2006 | Giannelli et al. | |
| 2006/0035755 | A1 * | 2/2006 | Dalebout et al. | 482/52 |
| 2006/0040794 | A1 | 2/2006 | Giannelli et al. | |
| 2006/0166791 | A1 | 7/2006 | Liao et al. | |
| 2006/0217236 | A1 * | 9/2006 | Watterson et al. | 482/54 |
| 2006/0234838 | A1 * | 10/2006 | Dalebout et al. | 482/57 |
| 2006/0247103 | A1 * | 11/2006 | Stearns et al. | 482/52 |
| 2006/0287161 | A1 * | 12/2006 | Dalebout et al. | 482/52 |
| 2007/0015633 | A1 | 1/2007 | Gerschefske et al. | 482/52 |
| 2007/0060449 | A1 * | 3/2007 | Lo | 482/52 |
| 2007/0060450 | A1 * | 3/2007 | Lo | 482/52 |
| 2007/0117683 | A1 * | 5/2007 | Ercanbrack et al. | 482/52 |
| 2007/0123393 | A1 | 5/2007 | Giannelli et al. | |
| 2007/0123394 | A1 * | 5/2007 | Ercanbrack et al. | 482/52 |
| 2007/0129217 | A1 | 6/2007 | Giannelli et al. | |
| 2007/0129218 | A1 * | 6/2007 | Dalebout et al. | 482/52 |
| 2007/0162823 | A1 | 7/2007 | Lin et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0200314 | A1 | 8/2008 | Dalebout et al. | |

FOREIGN PATENT DOCUMENTS

| | | |
|---|---|---|
| CN | 1315878 | 10/2001 |
| CN | 2516647 | 10/2002 |
| CN | 2696675 | 5/2005 |
| DE | 229712 | 1/1911 |
| FR | 498.150 | 6/1916 |
| WO | WO95/00209 | 1/1995 |
| WO | WO96/08292 | 3/1996 |
| WO | 99/58204 | 11/1999 |
| WO | WO 2006/138601 | 12/2006 |
| WO | WO 2008/103612 | 8/2008 |

OTHER PUBLICATIONS

Final Office Action dated Sep. 3, 2008, 10 pages, U.S. Appl. No. 10/916,684.

GearTrends Fitness 2007 edition, available on information and belief at least as early as Jun. 1, 2007 (6 pages).

Cybex Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commercial.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pp. 38-41, 66).

Brochure: "Reach Your Summit," 7 pages, available on information and belief at least as early as Nov. 1, 2006.

Operations Manual, 95Le Summit Trainer, LifeFitness, 53 pages, copyright 2006.

Operations Manual, 95Li Summit Trainer, LifeFitness, 39 pages, copyright 2006.
Assembly Instructions, 95Li Summit Trainer, LifeFitness, 10 pages, available on information and belief at least as early as Dec. 18, 2006.
LifeFitness, "Biomechanical Research Presents Benefits of New Summit Trainer," copyright 2006 (2 pages).
Vision Fitness-About Our Ellipticals, www.visionfitness.com, printed Sep. 13, 2005.
Photographs of Octane Fitness Exercise Device, available on information and belief at least as early as Sep. 2006, 8 photographs (3 pages).
Horizon Series E30 E20, printed on Jul. 27, 2004 from www.horizonfitness.com/horizon-series/ellipticals/e20.php, (1 page).
Horizon Elliptical Specs, printed on Jul. 27, 2004 from www.horizonfitness.com/horizon-series/ellipticals/elliptical-spec.php, (1 page).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006.
User's Manual, Pro-Form XP 520 Razor Elliptical Exerciser, Model No. 831.23744.0, 28 pages, available on information and belief at least as early as Jun. 19, 2007.
Office Action dated Dec. 14, 2007 from U.S. Appl. No. 10/916,684 (10 pages).
Office Action dated Jul. 18, 2008 from U.S. Appl. No. 11/155,328 (9 pages).
Office Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Septmeber 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body! "Total Body Workout," "Minimal Maintenance," "Small Footprint," "Retailers," available on informatin and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).
Office Action dated Jan. 7, 2009 from U.S. Appl. No. 11/155,328 (10 pages).
Office Action dated Jan. 29, 2009 from U.S. Appl. No. 10/916,684 (10 pages).
Office Action dated Apr. 3, 2009 from People's Republic of China Patent Application No. 200680021835.9 and English translation (21 pages).
Office Action dated Oct. 17, 2007 from U.S. Appl. No. 10/916,684 (7 pages).
Office Action dated Sep. 3, 2008 from U.S. Appl. No. 10/916,684 (11 pages).
Office Action dated Jun. 9, 2009 from U.S. Appl. No. 10/916,684 (11 pages).
Notice of Allowance dated May 18, 2009 from U.S. Appl. No. 11/155,328 (5 pages).
Office Action dated Jan. 22, 2009 from U.S. Appl. No. 11/549,530 (6 pages).
Office Action dated May 26, 2009 from U.S. Appl. No. 11/549,530 (9 pages).
Comments and Suggestions relating to Apr. 3, 2009 Office Action in People's Republic of China Patent Application No. 200680021835.9, Apr. 2000 (3 pages).
Office Action dated Sep. 22, 2009 from U.S. Appl. No. 11/155,328 (10 pages).
Amendment "B" and Response to Final Office Action from U.S. Appl. No. 11/155,328, submitted Apr. 7, 2009, 19 pages.
Amendment "C" and Response to Office Action from U.S. Appl. No. 11/549,530, submitted Aug. 26, 2009, 16 pages.
Amendment "F" With RCE After Final Office Action from U.S. Appl. No. 10/916,684, submitted Sep. 9, 2009, 17 pages.
Office Action dated Oct. 29, 2009 for U.S. Appl. No. 10/916,684 (9 pages).
Pro-Form 850 User's Manual (Model No. PFEL5105.0), available, on information and belief, at least as early as 2005, 24 pages.
Written Opinion of the International Searching Authority for International Application No. PCT/US08/54120, mailed Nov. 19, 2008, 7 pages.
Written Opinion of the International Searching Authority for International Application No. PCT/US06/23544, mailed Jan. 4, 2007, 4 pages.
Notice of Allowance and Fee(s) Due dated Feb. 19, 2010, 4 pages, U.S. Appl. No. 11/155,328.
Notice of Allowance and Fee(s) Due dated Jan. 29, 2010, 11 pages, U.S. Appl. No. 11/549,530.
Notice of Allowance and Fee(s) due (including Notice of Allowability) dated Feb. 29, 2010 from U.S. Appl. No. 10/916,684 (10 pages).

* cited by examiner

ONE-STEP FOLDABLE ELLIPTICAL EXERCISE MACHINE

BACKGROUND OF THE INVENTION

1. The Field of the Invention

This invention generally relates to exercise equipment and, more specifically, to elliptical exercise machines.

2. The Relevant Technology

Exercise machines having alternating reciprocating foot supports configured to traverse or travel about a closed path to simulate a striding, running, walking, and/or a climbing motion for the individual using the machine are well known, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point, with the other end supported in a manner configured to cause the reciprocating foot support to travel or traverse a closed path, such as a reciprocating elliptical or oblong path or other similar geometric outline. Therefore, upon operation of the exercise machine, each reciprocating foot support is caused to travel or traverse the closed path, thereby simulating a striding motion of the user for exercise purposes. The reciprocating foot supports are configured to be out of phase with one another by 180 degrees in order to simulate a proper and natural alternating stride motion.

An individual may utilize an elliptical exercise machine by placing his or her feet onto the reciprocating foot supports. The individual may then actuate the exercise machine for any desired length of time to cause the reciprocating foot supports to repeatedly travel their respective closed paths, which action effectively results in a series of strides achieved by the individual to obtain exercise, with a low-impact advantage. Therefore, there is a long standing need in the general area of exercise devices for a non-impact device, and one with an elliptical motion satisfies this need.

The user of an elliptical machine, however, is often faced with the dilemma of where to store their exercise machine when it is not in use. Thus, there is a need to provide an elliptical machine that allows for easy, safe, and quick storage.

BRIEF SUMMARY OF THE INVENTION

A folding elliptical exercise machine that allows for easy, safe, and quick storage and being capable, upon a single motion by a user, of changing its shape into a substantially compact form for storage, and vice versa, is provided. The elliptical exercise machine comprises a frame having a base support structure having a front portion and a rear portion, wherein the rear portion is rotatably attached to the front portion such that the elliptical exercise machine is movable between an operating position and a storage position, and first and second reciprocating foot supports interconnected to the frame, each foot support having a first end and a second end with a collapsible joint therebetween, wherein each reciprocating foot support is collapsible such that the exercise machine can be moved between the operating position and the storage position.

Each reciprocating foot support is collapsible such that the exercise machine can be moved between the operating position and the storage position in a single step by rotating the rear portion of the base support structure upward and toward the front portion of the base support structure. The frame further comprises an upright support structure and the first end of each reciprocating foot support is interconnected to the upright support structure. The exercise machine further comprises first and second swing arms, each swing arm having a first end and a second end, the first end of each swing arm being pivotally connected to the upright support structure and the second end of each swing arm being connected to the first end of each reciprocating foot support. Further, the elliptical exercise machine further comprises a drive assembly situated on the rear portion of the base support structure, wherein the second end of each reciprocating foot support is movably linked to the drive assembly.

The elliptical exercise machine further comprises a locking mechanism that, in the storage position, prevents the rear portion of the base support structure from inadvertently rotating with respect to the front portion of the base support structure. The exercise machine further comprises a release member for disengaging the locking mechanism such that the rear portion of the base support structure can rotate with respect to the front portion of the base support structure. Further, both the locking mechanism and the release member are situated on the rear portion of the base support structure.

The collapsible joint of each reciprocating foot support defines a forward portion and a rearward portion of each reciprocating foot support. Also, for proper functioning of the present invention, i.e., folding of the exercise machine in one motion by the user, the rearward portion of each reciprocating foot support has a curvature such that the collapsible joint, the first end of the reciprocating foot support, and the second end of the reciprocating foot support form three points of a triangle. Similarly, in one embodiment, the forward portion of each reciprocating foot support is about twice as long as the rearward portion of each reciprocating foot support.

A method for changing the position of the elliptical exercise machine of the present invention from an operating position to a storage position also is provided. The method consisting of rotating the rear portion of the base support structure upward and toward the front portion of the base support structure. Another disclosed method consists of rotating the rear portion of the machine upward and toward the front portion of the machine, where the machine is defined as having only a front portion and a rear portion. Lastly, a method for changing the position of the elliptical exercise machine from an operating position to a storage position or from a storage position to an operating position is disclosed in which the method consists of rotating the rear portion of the base support structure either upward and toward the front portion of the machine to change the machine from an operating position to a storage position, or downward and toward a support surface to change the machine from a storage position to an operating position.

BRIEF DESCRIPTION OF THE DRAWINGS

In order that the manner in which the above-recited and other advantages and objects of the invention are obtained, a more particular description of the invention briefly described above will follow by reference to specific embodiments thereof that are illustrated in the appended drawings. These drawings depict only typical embodiments of the invention. They are not, therefore, to be considered to be limiting of its scope. The invention will be described and explained with additional specificity and detail through the use of the accompanying drawings in which.

DETAILED DESCRIPTION OF THE PREFERRED EMBODIMENTS

The following detailed description of exemplary embodiments of the invention makes reference to the accompanying drawings, which show, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in the figures, is not intended to limit the scope of the invention, as claimed. It is presented for purposes of illustration only and to describe the features and characteristics of the present invention, to set forth the best mode of operation of the invention, and to sufficiently enable one skilled in the art to practice the invention. Accordingly, the scope of the present invention is to be defined solely by the appended claims. The following detailed description and exemplary embodiments of the invention will be best understood by reference to the accompanying drawings, wherein the elements and features of the invention are designated by numerals throughout.

The present invention describes and features an exercise machine, and particularly an elliptical or elliptical-type exercise machine that is capable, upon a single motion by a user, of changing its shape into a substantially compact form for storage. In a single step, the entire exercise device is capable of folding upon itself, allowing the user to readily change the configuration of the machine from an operating position to a compact, storage position.

With reference to the accompanying drawings, advantages of the present invention will be apparent in light of the detailed description set forth below. These advantages are not meant to be limiting in any way. Indeed, other than those specifically recited herein, one skilled in the art will appreciate that other advantages may be realized, upon practicing the present invention.

Figure 1:
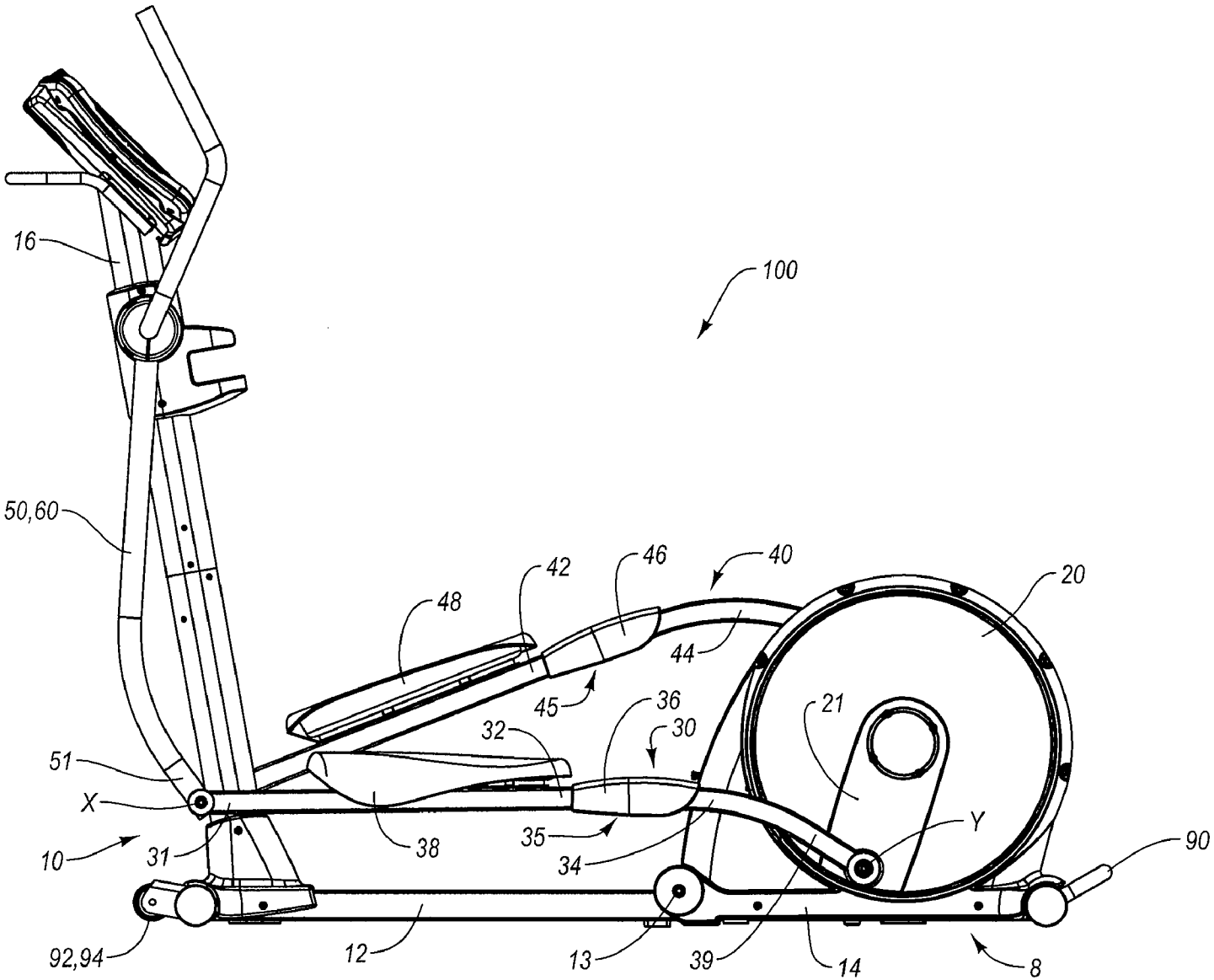
FIG. 1 illustrates a side view of a rear mechanical-type elliptical exercise machine according to the present invention in its operating position.

FIG. 1 shows a side view of the rear mount or rear mechanical-type elliptical exercise device 100 in its operating position. The elliptical exercise device 100 comprises a frame 10, a drive assembly 20, a first reciprocating foot support 30, a second reciprocating foot support 40, and first and second swing arms 50 and 60 pivotally coupled to the frame 10. The frame 10 comprises a base support structure 8, which comprises a front portion 12 and a rear portion 14, and an upright support structure 16, about which the swing arms 50 and 60 pivot.

The first reciprocating foot support 30 comprises forward 32 and rearward portions 34, a first collapsible joint 35 therebetween, a first joint cover 36, and a first foot pad 38. The second reciprocating foot support 40 comprises forward 42 and rearward portions 44, a second collapsible joint 45 therebetween, a second joint cover 46, and a second foot pad 48. In the operating position of FIG. 1, the elliptical exercise machine 100 of the present invention operates in the same manner as does a conventional elliptical exercise machine. Similarly, its parts are generally connected to each other in a conventional manner. With respect to the first side of the elliptical exercise machine 100, the first swing arm 50 has a lower end 51 that is connected to the forward end 31 of the first reciprocating foot support 30 at linkage point X. The rearward end 39 of the first reciprocating foot support 30 is rotatably connected to the crank 21 of the drive assembly 20 at linkage point Y. The respective parts of the second side of the elliptical exercise machine 100 are connected in the same manner as the right side, except that the sides are offset by 180 degrees.

Figure 2:
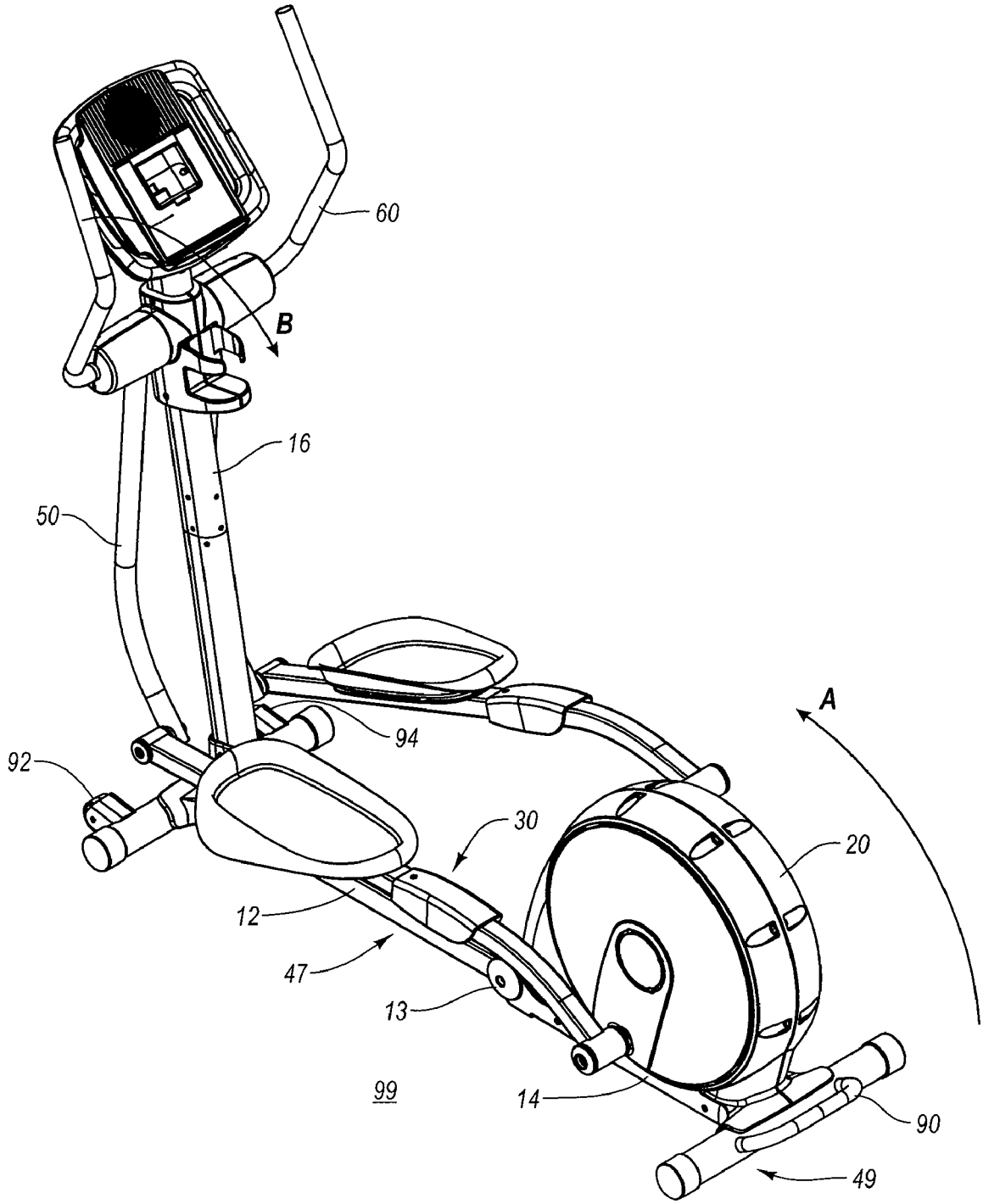
FIG. 2 illustrates a perspective view of the elliptical exercise machine of FIG. 1 in its operating position.

FIG. 2 shows a perspective view of the elliptical exercise machine 100 of FIG. 1. As shown, the front portion 12 and the rear portion 14 of the base support structure 8 are separated by a pivot point 13. The elliptical exercise machine 100 further comprises wheels 92 and 94 situated on the front portion 12 of the base support structure 8, as well as a handle 90 on the rear portion 14 of the base support structure 8. To place the elliptical exercise machine 100 in the storage position, the user merely grabs hold of the handle 90 and rotates it, along with the rear portion 14 of the base support structure 8 and drive assembly 20, upward and toward the upright support structure 16 (in the direction of arrow A).

In a way, the pivot point 13 defines a front portion 47 and a rear portion 49 of the machine 100, in which the rear portion 49 comprises the rear portion 14 of the base support structure 8, the drive assembly 20 and handle 90, and the front portion 47 comprises the remaining components of machine 100. Under these terms, to place the elliptical exercise machine 100 in the storage position, the user merely rotates the rear portion 49 of the machine 100 upward and toward the front portion 49 of the machine 100.

Figure 3:
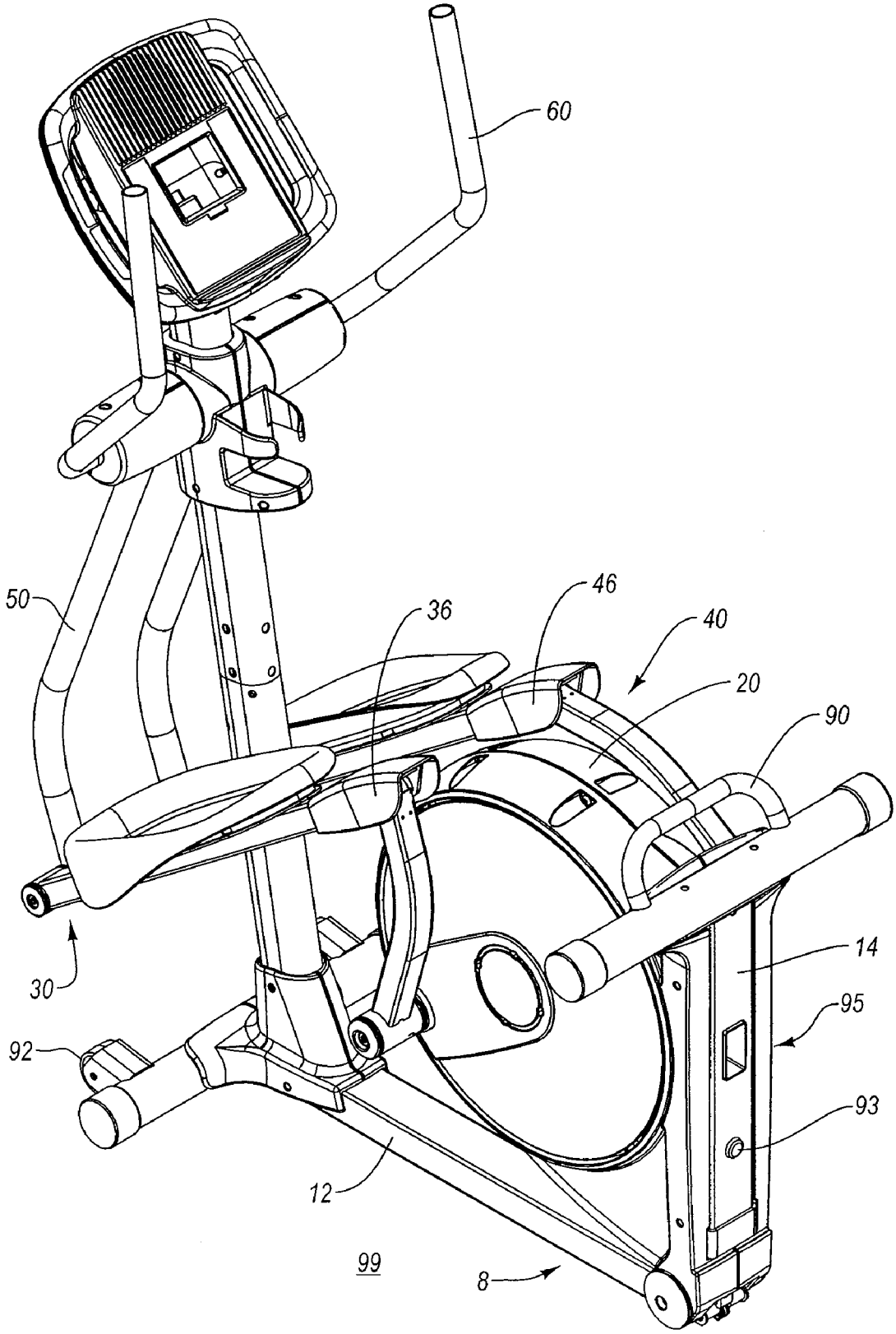
FIG. 3 illustrates a perspective view of the elliptical exercise machine of FIG. 1 in its storage position.

FIG. 3 shows the elliptical exercise machine 100 in its storage position. During the folding process, the first and second reciprocating foot supports 30 and 40 break away into their respective forward and rearward portions, as shown in FIG. 3. Also as shown in FIG. 3, the joint covers 36 and 46 are provided on the first and second reciprocating foot supports 30 and 40 to prevent accidental injury when the elliptical exercise machine 100 is in its storage position.

Once the elliptical exercise machine 100 is in its storage position, the user can tilt the entire machine 100 forward, balancing it on its wheels 92 and 94 and roll the machine 100 to any desired location. As shown in FIG. 3, in its storage position the machine 100 has a smaller footprint than when the machine 100 is in its operating position, as shown in FIGS. 1 and 2. To place the machine 100 back in its operating position, the user merely takes hold of handle 90 and rotates it, along with the rear portion 14 of the base support structure 8 and drive assembly 20, back down and toward the support surface.

Elliptical exercise machine 100 further comprises a locking mechanism 95 situated on the rear portion 14 of the base support structure 8 that prevents the machine 100 from inadvertently returning to the operating position, i.e., from inadvertently falling back down to the support surface 99. When the user wants to move the machine 100 from the storage position to the operating position, he or she presses a release member or button 93 situated on the rear portion 14 of the base support structure 8 to disengage the locking mechanism 95 and grabs the handle 90 to rotate the rear portion 14 and the drive assembly 20 downward until the rear portion 14 is on the support surface 99 in its operating position.

Although the locking mechanism 95 may take many forms, one that works with the elliptical exercise machine 100 of FIG. 3 is shown and disclosed in co-pending and commonly assigned U.S. application Ser. No. 11/549,530, filed Oct. 13, 2006, entitled "Folding Elliptical Exercise Machine," published on Jun. 7, 2007 with Pre-grant Publication No. 2007/0129218 A1, which is hereby incorporated herein by reference in its entirety.

Figure 4A:
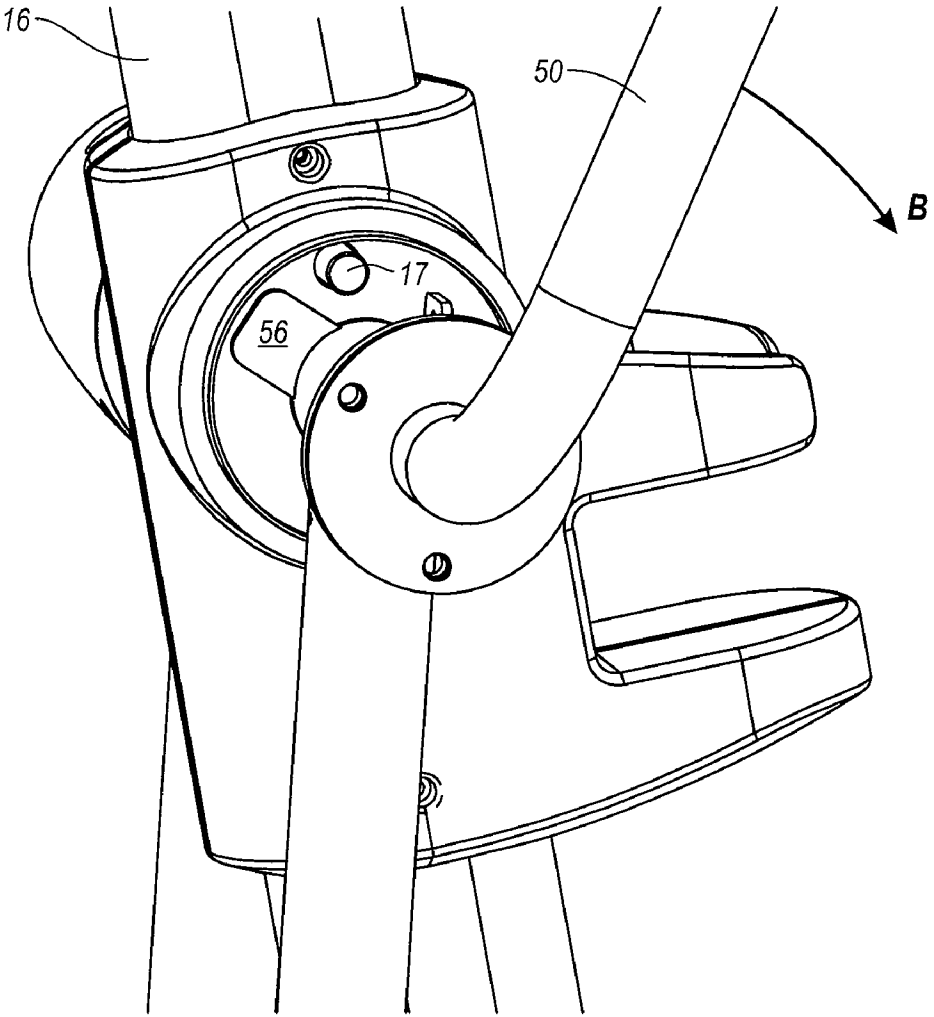
FIG. 4A illustrates an enlarged, cut-away perspective view of the elliptical exercise machine of FIG. 1, and in particular, the area where the first swing arm is pivotally connected to the upright support structure.
Figure 4B:
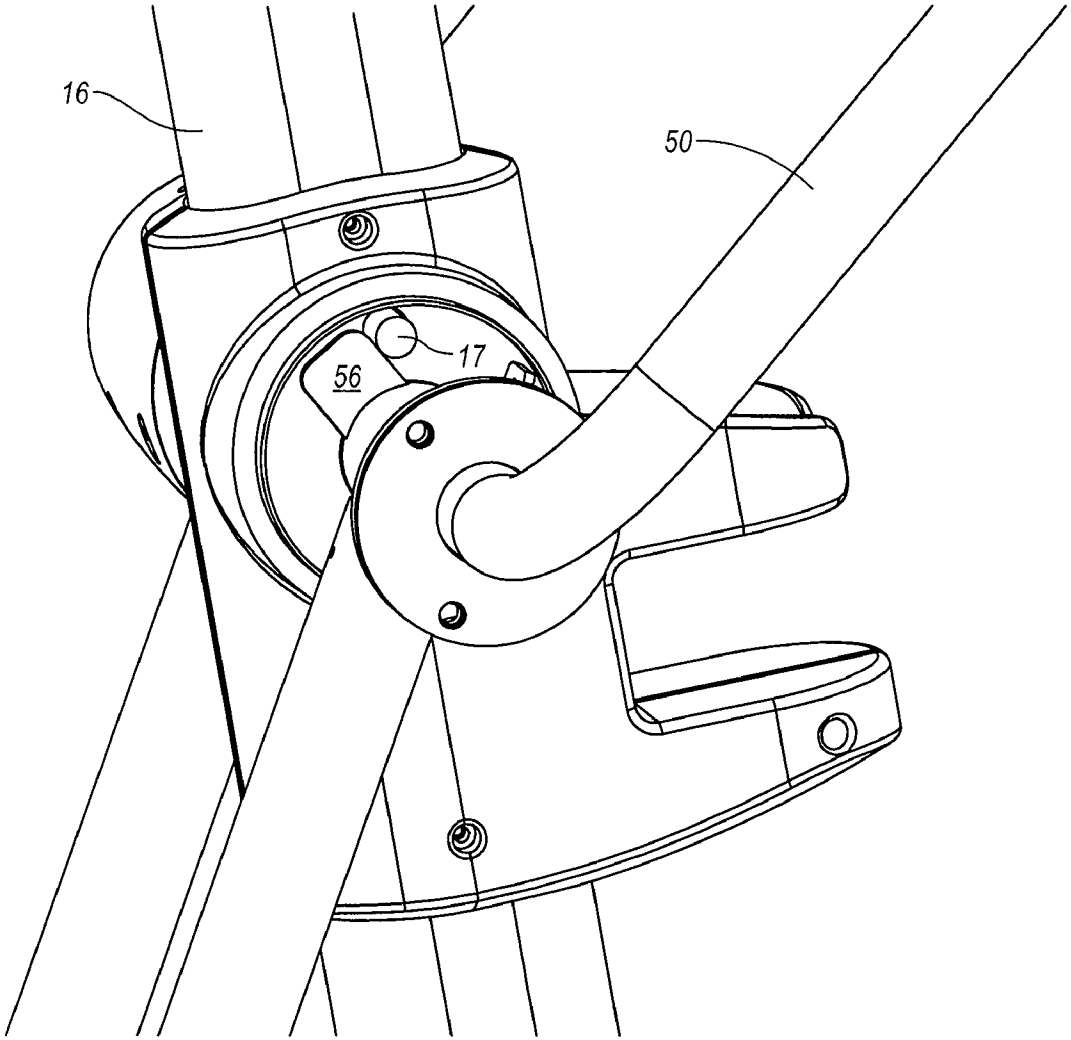
FIG. 4B illustrates another enlarged, cut-away perspective view of the elliptical exercise machine of FIG. 1, and in particular, the area where the first swing arm is pivotally connected to the upright support structure.

FIG. 4A shows an enlarged, cut-away perspective view of the elliptical exercise machine of FIG. 1, and in particular, the area where the first swing arm 50 is pivotally connected to the upright support structure 16, with a cover removed to depict the inner workings of that area. Specifically, FIG. 4A shows a critical aspect of the present invention and features that initiate the process of the first and second reciprocating foot supports 30 and 40 breaking into their respective forward and rearward portions. As the user grabs hold of the handle 90 and rotates it, along with the rear portion 14 of the base support structure 8 and drive assembly 20, upward and toward the upright support structure 16, this action moves the first reciprocating foot support 30 forward. Moving the first reciprocating foot support 30 forward rotates the first swing arm 50 clockwise as shown in FIG. 4A (and in the direction of arrow B in FIGS. 2 and 4A). This clockwise motion of the first swing arm 50 is a rotation that is greater than that experienced during normal operation of the exercise machine 100. Accordingly, when this clockwise motion is imparted to the first swing arm 50 during the beginning of the folding operation, a first flange 56 on swing arm 50 contacts a first stop 17 on upright support structure 16, as shown in FIG. 4B. The abutment of the first flange 56 and the first stop 17 causes the first swing arm 50 to stop rotating. The continued motion of the first reciprocating foot support 30, however, causes the reciprocating foot support 30 to break into its forward 32 and rearward portions 34. The second reciprocating foot support 40 operates in the same manner as does the first reciprocating foot support 30.

Figure 5:
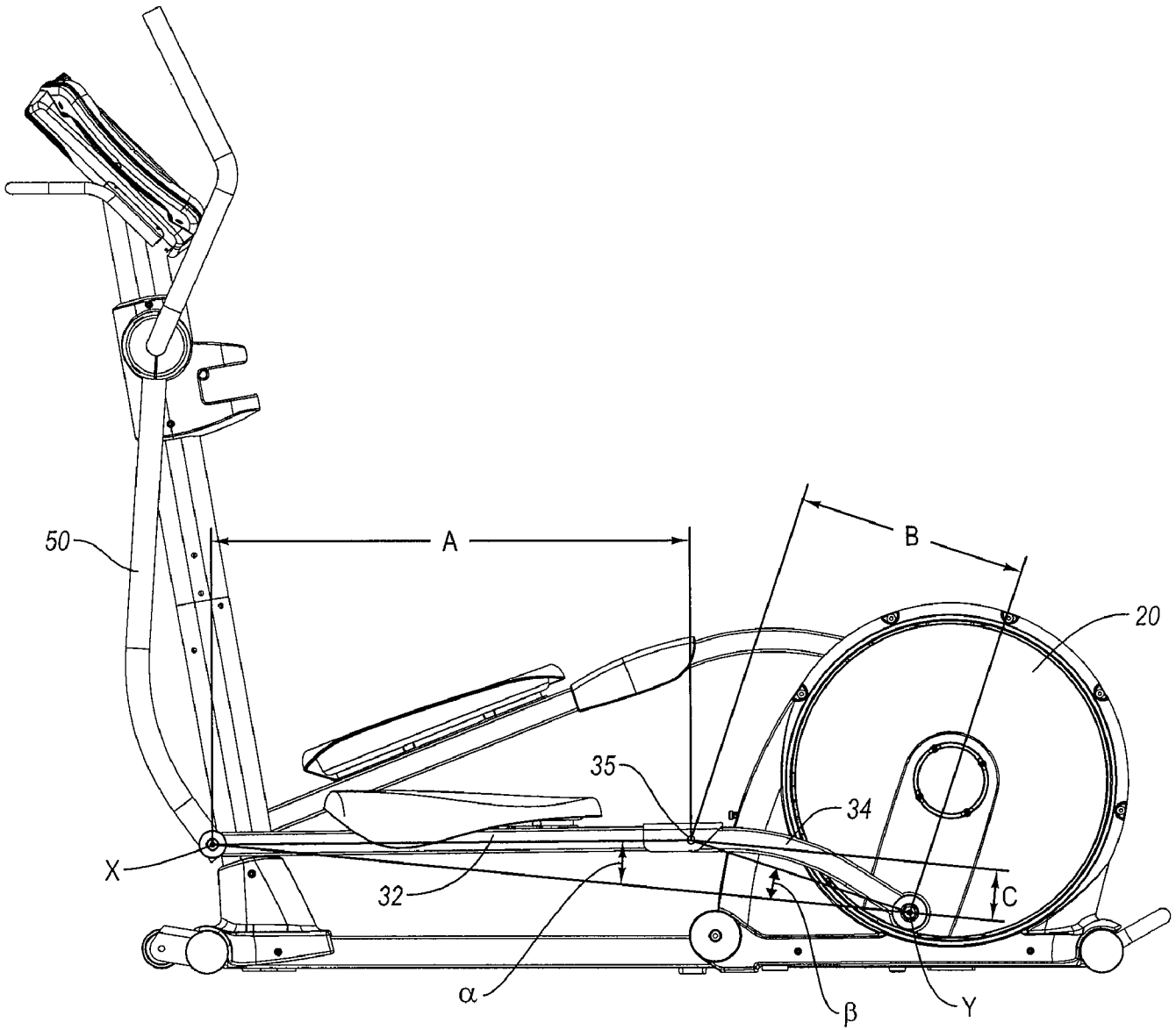
FIG. 5 illustrates another side view of the elliptical exercise machine, which depicts an important aspect of the present invention.

FIG. 5 shows another side view of the elliptical exercise machine 100, which depicts another important aspect of the present invention. It has been discovered that the relationship between the forward and rearward portions of each reciprocating foot support 30 and 40 is an important relationship in allowing the reciprocating foot supports 30 and 40 to break into their respective forward and rearward portions when the user rotates the handle 90, along with the rear portion 14 of the base support structure 8 and drive assembly 20, upward and toward the upright support stricture 16. For illustrative purposes only, this relationship is depicted in FIG. 5 with respect to the first reciprocating foot support 30. The distance from point X (where the first swing arm 50 is connected to the first reciprocating foot support 30) to the first collapsible joint 35 is represented by "A." The distance from point Y (where the first reciprocating foot support 30 is rotatably connected to the drive assembly 20) to the first collapsible joint 35 is represented by "B." As shown in FIG. 5, points X, Y and first collapsible joint 35 forms form three points or corners of a triangle.

That points X, Y and joint 35 form points of a triangle is an important aspect of the present invention in allowing the reciprocating foot supports 30 and 40 to break into their respective forward and rearward portions when the user rotates the rear portion 49 of the machine 100 upward and toward the front portion 49 of the machine 100. As shown in FIG. 5, note that points X, Y and joint 35 form a triangle because rear portion 34 of first reciprocating foot support 30 has a curvature. Without this curvature, or some equivalent to provide a triangular relationship, breaking the reciprocating foot supports 30 and 40 into their respective forward and rearward portions when the user rotates the rear portion 49 of the machine 100 upward and toward the front portion 49 will not work, or will not work as well as that of the disclosed triangular relationship. Although other dimensions will work, with the elliptical exercise machine 100 of FIGS. 1-5, distance A is 30.316 inches, distance B is 14.612 inches, angle " is 6 degrees, and angle β is 13 degrees. Lastly, the height of this triangle is represented by the letter "C" and is 3.229 inches.

Regardless of the exact dimensions of the triangle described above, it is desirable to allow the user to either place the machine 100 in the storage position or place the machine 100 in the operating position with nominal effort or force. In addition to the dimensions described above, another way to accomplish this goal is to provide the elliptical exercise machine 100 wherein the ratio of the length of the forward portion to the length of the rearward portion of each reciprocating foot support 30 and 40 is such that the user need only impart a nominal force to cause the exercise machine to be moved from the operating position to the storage position.

In addition to the elliptical exercise machine 100 of the present invention, a method of changing the position of an elliptical exercise machine, i.e., between an operating position and a storage position also is disclosed. As set forth above, to change the position, the user need only grab the handle 90, along with the rear portion 14 of the base support structure 8 and drive assembly 20, and rotate upward or downward accordingly. The user rotates upward and toward the upright support structure 16 to place the machine 100 in the storage position, whereas the user rotates downward and toward the support surface 99 to place the machine 100 in the operating position. To accomplish either maneuver, the user need only perform this single step. For example, the user need not take the time to dissemble the reciprocating foot supports 30 or 40 or any other part of the elliptical machine 100 before he or she folds the machine 100. Folding is the only necessary step.

Thus, the present invention provides an elliptical machine that allows for easy, safe, and quick storage by being capable, upon a single motion by a user, of changing its shape into a substantially compact form for storage, and vice versa. In a single step, the entire exercise device is capable of folding upon itself, allowing the user to readily change the configuration of the machine from an operating position to a compact, storage position and vice versa.

Although multiple embodiments of the invention are described herein in detail, it will be understood by those skilled in the art that variations may be made thereto without departing from the spirit of the invention or the scope of the claims.

We claim:

1. A folding elliptical exercise machine comprising:

a frame having a base support structure having a front portion and a rear portion, wherein the rear portion is rotatably attached to the front portion such that the elliptical exercise machine is movable between an operating position and a storage position; and first and second reciprocating foot supports interconnected to the frame, each foot support having a first end and a second end with a collapsible joint there between, wherein each reciprocating foot support is collapsible such that the exercise machine can be moved between the operating position and the storage position, wherein each foot support also has a forward and a rearward portion and the rearward portion of each foot support is interconnected to a drive assembly situated on the rear portion of the base support structure and wherein each foot support collapses in response to the elliptical exercise machine being folded, such that both the foot supports and drive assembly move up together and are maintained together in the storage position.

2. The elliptical exercise machine of claim 1, wherein each reciprocating foot support is collapsible such that the exercise machine can be moved between the operating position and the storage position in a single step by rotating the rear portion of the base support structure upward and toward the front portion of the base support structure, and wherein the rear portion of the base support structure includes a user graspable handle located and configured such that a user can grasp the handle and rotate the exercise machine from the operating position to the storage position by moving the rear portion of the base support structure upward toward the front portion of the base support structure.

3. The elliptical exercise machine of claim 1, wherein the frame further comprises an upright support structure and the first end of each reciprocating foot support is interconnected to the upright support structure.

4. The elliptical exercise machine of claim 3 further comprising:

first and second swing arms, each swing arm having a first end and a second end, the first end of each swing arm being pivotally connected to the upright support structure and the second end of each swing arm being connected to the first end of each reciprocating foot support.

5. The elliptical exercise machine of claim 1 further comprising:

a drive assembly situated on the rear portion of the base support structure, wherein the second end of each reciprocating foot support is movably linked to the drive assembly.

6. The elliptical exercise machine of claim 1 further comprising:

a locking mechanism that, in the storage position, prevents the rear portion of the base support structure from inadvertently rotating with respect to the front portion of the base support structure.

7. The elliptical exercise machine of claim 6 further comprising:

a release member for disengaging the locking mechanism such that the rear portion of the base support structure can rotate with respect to the front portion of the base support structure.

8. The elliptical exercise machine of claim 7, wherein the locking mechanism and the release member are situated on the rear portion of the base support structure.

9. The elliptical exercise machine of claim 1, wherein the collapsible joint of each reciprocating foot support defines the forward portion and the rearward portion of each reciprocating foot support and wherein the forward portion of each reciprocating foot support is about twice as long as the rearward portion of each reciprocating foot support.

10. The elliptical exercise machine of claim 1, wherein the collapsible joint of each reciprocating foot support defines the forward portion and the rearward portion of each reciprocating foot support and wherein the forward portion of each reciprocating foot support is at least twice as long as the rearward portion of each reciprocating foot support.

11. The elliptical exercise machine of claim 1, wherein the collapsible joint of each reciprocating foot support defines the forward portion and the rearward portion of each reciprocating foot support and wherein a ratio of length of the forward portion of each reciprocating foot support to length of the rearward portion of each reciprocating foot support is such that a user need only impart a nominal force to cause the exercise machine to be moved from the operating position to the storage position.

12. The elliptical exercise machine of claim 1, wherein the collapsible joint of each reciprocating foot support defines the forward portion and the rearward portion of each reciprocating foot support and, wherein for each reciprocating foot support, the rearward portion has a curvature such that the collapsible joint, the first end of the reciprocating foot support, and the second end of the reciprocating foot support form three points of a triangle.

13. A folding elliptical exercise machine comprising:

a frame having a base support structure having a front portion and a rear portion, wherein the rear portion is rotatably attached to the front portion such that the elliptical exercise machine is movable between an operating position and a storage position; and first and second reciprocating foot supports, each foot support having a forward portion, a rearward portion, a first end situated on the forward portion, and a second end situated on the rearward portion, the first end of each reciprocating foot support being interconnected to the frame, the second end of each reciprocating foot support being movably linked to a drive assembly situated on the rear portion of the base support structure, wherein each reciprocating foot support collapses in response to the rear portion of the base support structure being rotated with respect to the front portion of the base support structure such that the exercise machine can be moved between the operating position and the storage position.

14. The elliptical exercise machine of claim 13, wherein each reciprocating foot support is collapsible such that the exercise machine can be moved between the operating position and the storage position in a single step by rotating the rear portion of the base support structure upward and toward the front portion of the base support structure.

15. The elliptical exercise machine of claim 13, wherein the frame further comprises an upright support structure and the first end of each reciprocating foot support is interconnected to the upright support structure.

16. The elliptical exercise machine of claim 15 further comprising:

first and second swing arms, each swing arm having a first end and a second end, the first end of each swing arm being pivotally connected to the upright support structure and the second end of each swing arm being connected to the first end of each reciprocating foot support.

17. The elliptical exercise machine of claim 13 further comprising:

a locking mechanism that, in the storage position, prevents the rear portion of the base support structure from inadvertently rotating with respect to the front portion of the base support structure.

18. The elliptical exercise machine of claim 17 further comprising:

a release member for disengaging the locking mechanism such that the rear portion of the base support structure can rotate with respect to the front portion of the base support structure.

19. The elliptical exercise machine of claim 18, wherein the locking mechanism and the release member are situated on the rear portion of the base support structure.

20. The elliptical exercise machine of claim 13, wherein the forward portion of each reciprocating foot support is about twice as long as the rearward portion of each reciprocating foot support.

21. The elliptical exercise machine of claim 13, wherein the forward portion of each reciprocating foot support is at least twice as long as the rearward portion of each reciprocating foot support.

22. The elliptical exercise machine of claim 13, wherein a ratio of length of the forward portion of each reciprocating foot support to length of the rearward portion of each reciprocating foot support is such that a user need only impart a nominal force to cause the exercise machine to be moved from the operating position to the storage position.

23. The elliptical exercise machine of claim 13, wherein each reciprocating foot support further comprises a collapsible joint situated between the first end and second end of each reciprocating foot support, and wherein for each reciprocating foot support, the rearward portion has a curvature such that the collapsible joint, the first end of the reciprocating foot support, and the second end of the reciprocating foot support form three points of a triangle.

24. A folding elliptical exercise machine comprising:

a frame having a front portion and a rear portion, wherein the rear portion of the frame is rotatably attached to the front portion of the frame such that the elliptical exercise machine is movable between an operating position and a storage position; and first and second reciprocating foot supports, each foot support having a first end and a second end with a collapsible joint therebetween, wherein each reciprocating foot support is collapsible such that the exercise machine can be moved between the operating position and the storage position in a single step by rotating the rear portion of the frame upward and toward the front portion of the frame, wherein the first end of the each foot support is interconnected to the front portion of the frame and the second end of each foot support is linked to a drive mechanism mounted on the rear portion of the frame, and wherein each foot support collapses at the collapsible joint thereof in response to rotation of the rear portion of the frame upward toward the front portion of the frame.

25. The elliptical exercise machine of claim 24, wherein the frame further comprises an upright support structure and the first end of each reciprocating foot support is interconnected to the upright support structure.

26. The elliptical exercise machine of claim 24 further comprising:

first and second swing arms, each swing arm having a first end and a second end, the first end of each swing arm being pivotally connected to the upright support structure and the second end of each swing arm being connected to the first end of each reciprocating foot support.

27. The elliptical exercise machine of claim 24 further comprising:

a drive assembly situated on the rear portion of the base support structure, wherein the second end of each reciprocating foot support is movably linked to the drive assembly.

28. The elliptical exercise machine of claim 24 further comprising:

a locking mechanism that, in the storage position, prevents the rear portion of the base support structure from inadvertently rotating with respect to the front portion of the base support structure.

29. The elliptical exercise machine of claim 26 further comprising:

a release member for disengaging the locking mechanism such that the rear portion of the base support structure can rotate with respect to the front portion of the base support structure.

30. The elliptical exercise machine of claim 27, wherein the locking mechanism and the release member are situated on the rear portion of the base support structure.

31. The elliptical exercise machine of claim 24, wherein the collapsible joint of each reciprocating foot support defines a forward portion and a rearward portion of each reciprocating foot support and wherein the forward portion of each reciprocating foot support is about twice as long as the rearward portion of each reciprocating foot support.

32. The elliptical exercise machine of claim 24, wherein the collapsible joint of each reciprocating foot support defines a forward portion and a rearward portion of each reciprocating foot support and wherein the forward portion of each reciprocating foot support is at least twice as long as the rearward portion of each reciprocating foot support.

33. The elliptical exercise machine of claim 24, wherein the collapsible joint of each reciprocating foot support defines a forward portion and a rearward portion of each reciprocating foot support and wherein a ratio of length of the forward portion of each reciprocating foot support to length of the rearward portion of each reciprocating foot support is such that a user need only impart a nominal force to cause the exercise machine to be moved from the operating position to the storage position.

34. The elliptical exercise machine of claim 24, wherein the collapsible joint of each reciprocating foot support defines a forward portion and a rearward portion of each reciprocating foot support, and wherein for each reciprocating foot support, the rearward portion has a curvature such that the collapsible joint, the first end of the reciprocating foot support, and the second end of the reciprocating foot support form three points of a triangle.

35. A folding elliptical exercise machine comprising:

a frame having a base support structure having a front portion and a rear portion, wherein the rear portion is rotatably attached to the front portion such that the elliptical exercise machine is movable between an operating position and a storage position; and first and second reciprocating foot supports interconnected to the frame, each foot support having a first end and a second end with a collapsible joint therebetween, wherein each reciprocating foot support is collapsible such that the exercise machine can be moved between the operating position and the storage position in a single step by rotating the rear portion of the base support structure upward and toward the front portion of the base support structure, wherein each foot support is configured to bend at the collapsible joint as the rear portion of the base support structure rotates upward toward the front portion of the base support structure, and wherein each foot support bends at the collapsible joint when (i) the movement of a first portion of the foot support is restricted as the rear portion of the base support structure rotates upward and (ii) the rear portion of the base support structure continues to rotate further upward, thereby causing a second portion of the foot support to continue moving until the foot support bends at the collapsible joint, and wherein the first foot support portion is stopped when an interconnecting member connecting the first foot support portion to the frame contacts the frame and thereby stops moving with respect to the frame, such that movement of the rear portion of the base support structure further upward causes the foot support to bend at the collapsible joint.

36. A folding elliptical exercise machine comprising:

a frame having a base support structure having (i) a front portion; and (ii) a rear portion, wherein the rear portion is rotatably attached to the front portion such that the elliptical exercise machine is movable between an operating position and a storage position; and first and second reciprocating foot supports interconnected to the frame by a respective interconnecting member, each foot support having a front end and a rear end with a collapsible joint therebetween, wherein each reciprocating foot support is collapsible such that the exercise machine can be moved between the operating position and the storage position in a single step by rotating the rear portion of the base support structure upward and toward the front portion of the base support structure, wherein each foot support is configured to bend at the collapsible joint as the rear portion of the base support structure rotates upward toward the front portion of the base support structure, and wherein each foot support bends at the collapsible joint when (i) the movement of the interconnecting member connecting the front portion of the foot support to the frame is stopped as the rear portion of the base support structure rotates upward while (ii) the rear portion of the base support structure continues to rotate further upward, thereby causing the rear portion of the foot support to continue moving until the foot support bends at the collapsible joint, and wherein the first foot support bends to a collapsed position as the rear portion of the base support structure rotates upward, after which the second foot support bends to a collapsed position as the rear portion of the base support structure rotates further upward.

37. A folding elliptical exercise machine as recited in claim 36, wherein each interconnecting member is rotatably coupled to the frame and to a respective foot support and wherein the frame has first and second stop members, each stop member being contacted by a respective interconnecting member as the rear portion of the base is rotated upwardly with respect to the front portion of the base.

* * * * *